US007846000B2

(12) United States Patent
Cox

(10) Patent No.: US 7,846,000 B2
(45) Date of Patent: Dec. 7, 2010

(54) SURFBOARD AND METHOD OF CONSTRUCTION

(75) Inventor: Hayden Charles Cox, Mona Vale (AU)

(73) Assignee: Hayden Cox Pty Limited, Mona Vale, NSW (AU)

( * ) Notice: Subject to any disclaimer, the term of this patent is extended or adjusted under 35 U.S.C. 154(b) by 0 days.

(21) Appl. No.: 11/971,318

(22) Filed: Jan. 9, 2008

(65) Prior Publication Data

US 2008/0287017 A1 Nov. 20, 2008

(30) Foreign Application Priority Data

May 15, 2007 (AU) ..... 2007100389
May 22, 2007 (AU) ..... 2007202298

(51) Int. Cl.
*A63C 5/03* (2006.01)
*B63B 35/81* (2006.01)

(52) U.S. Cl. ..... 441/74

(58) Field of Classification Search ..... 441/65, 441/74; 114/39.12, 39.14
See application file for complete search history.

(56) References Cited

U.S. PATENT DOCUMENTS

| | | | | |
|---|---|---|---|---|
| 4,209,867 | A * | 7/1980 | Abrams, III | 441/74 |
| 4,713,032 | A | 12/1987 | Frank | |
| 4,964,825 | A | 10/1990 | Paccoret et al. | |
| 5,514,017 | A | 5/1996 | Chimiak | |
| 6,623,323 | B1 | 9/2003 | Mead | |
| 2003/0008575 | A1 | 1/2003 | Leonard | |

FOREIGN PATENT DOCUMENTS

| | | | |
|---|---|---|---|
| AU | 199528411 | A1 | 2/1996 |
| WO | 03/101719 | A | 12/2003 |

* cited by examiner

*Primary Examiner*—Daniel V Venne
(74) *Attorney, Agent, or Firm*—McDonnell Boehnen Hulbert & Berghoff LLP

(57) ABSTRACT

Disclosed is a surfboard (10) comprising a foam blank (10), rails (14) formed using carbon fiber materials (22) on the blank, and a fiberglass laminate enveloping the rails and blank. Alternatively, the blank and rails may be enveloped in a thermally active PVC or similar material.

2 Claims, 4 Drawing Sheets

SURFBOARD AND METHOD OF CONSTRUCTION

TECHNICAL FIELD

The present invention relates to surfboards and, in particular, discloses a surfboard which utilises carbon materials in the rails of the surfboard, and a method of manufacturing the same.

BACKGROUND

Traditional surfboard manufacture utilises a blank, typically formed of polystyrene, incorporating a centreline stringer, typically formed of balsa wood, and which provides strength and rigidity to the board. The foam blank and stringer are then encased in a fiberglass shell formed of fiberglass mating and polyester resin. Whilst the peripheral shape of the board may vary depending upon the style of wave to be ridden and the skill or preference of the rider, this traditional "fibreglass" form of construction has been a standard in the industry for more than fifty years.

Other foam materials, such as polyurethane and EPS (expandable polystyrene) may be used, in which case epoxy resin is used to harden the fiberglass shell. These alternate materials have become popular over the past 5 or so years. These alternate materials are lighter in weight and are more flexible than the traditional materials. Ultra-violet stabilised epoxy resins are also now available which permit that hardener to be used with polystyrene blanks. Stringers may also be formed of plywood.

Variations on these methods of construction provide for the use of additional stringers. For example, three stringers have often been used in the formation of so-called "longboards", having a length of about 8 feet (2.4 meters) or more. The traditional fiberglass forms of constructions are popular with relatively small local manufacturers who can easily customise shapes to the desires of their clients. Polystyrene is well suited to shaping with hand tools and the like.

Relatively recently, other forms of manufacture have evolved that are better suited to mass, substantially automated, manufacture. These generally include use of the alternate materials mentioned above. One example is the TUFLITE™ form which includes a shaped EPS foam blank laminated with thermally formed plastics layers, such as PVC.

One problem with is that the stringer is used to provide strength to the board, whilst retaining some longitudinal flexibility. Nevertheless, the boards tend to twist under pressure whilst being ridden. Maintaining transverse rigidity to avoid twisting of the board provides a more stable platform for the rider in variable conditions. Additional transverse rigidity is generally provided by increasing the size of the fiberglass coating. This can be achieved by using additional layers of fiberglass matting, or using layers of increased mass. However this can increase the weight of the board, thereby reducing its buoyancy. Even with the TUFLITE™ process mentioned above, which uses foam said to be 30% lighter than traditional foams, multiple laminations are used to increase the strength of the board.

SUMMARY

It is an object of the present invention to substantially overcome, or at least ameliorate one or more problems with existing arrangements.

Disclosed is a method of surfboard construction which removes the need for a traditional internal stringer and provides for a carbon fiber reinforced rail enveloping the periphery of a foam blank.

In accordance with one aspect of the present invention there is disclosed a surfboard that comprises a parabolic carbon rail.

In accordance with another aspect of the present invention there is disclosed a surfboard characterised by a peripheral carbon fiber frame.

Also disclosed is a surfboard comprising a foam blank having a top side, an under side, and a shaped peripheral rail extending between the top side and the under side. The rail is further formed using carbon fiber materials extending along and over the rail and at least to one of the top side and under side of the blank to form a carbon fiber reinforced frame around and substantially limited to the rail line of the surfboard.

According to another aspect a surfboard comprises a foam blank having a top side, an under side, and a shaped peripheral rail extending between the top side and the under side. Carbon fiber materials are applied to and extend along and over the rail and onto each of a periphery of the top side and a periphery of the under side of the blank. This forms a peripheral carbon fiber frame around and substantially limited to the rail line of the surfboard. A non-carbon fiber laminate is used to envelope the carbon fiber rail, the top side and the under side.

In contrast to traditional arrangements, which achieve a surfboard flex pattern by means of a centreline wood stringer, the arrangements described herein achieve a flex pattern by virtue of a, preferably parabolic, carbon rail around the surfboard. This improves the speed and response of the surfboard as the flex pattern is now on the rail line of the board and because carbon has a very quick flex memory.

The carbon rail is created via carbon fiber being laminated around the rail of the surfboard following the rail line. The carbon rail creates a frame around the outline of the surfboard and goes from the deck of the surfboard to the bottom of the surfboard.

Other aspects of the invention include:

- the surfboard being characterised by the blank being stringerless;
- the blank including at least one stringer;
- the carbon fiber material comprising a matting of material extending around the rail from a top side and an under side of the blank;
- the matting comprising at least two matting portions overlapping at a periphery of the rail and each extending onto one of the topside and the underside of the blank;
- the carbon fiber material comprising a unidirectional weave;
- the laminate being formed using fiberglass and resin; and
- the carbon fiber material on the rail is cured in resin and the rail and blank are laminated in a thermally active plastics material.

According to another aspect of the present invention there is disclosed a method of manufacturing a surfboard, the method comprising the steps of (a) applying carbon fiber material to the rails of a shaped surfboard blank; and (b) enveloping the rails and the blank in a non-carbon fiber laminate.

According to another aspect of the present invention there is disclosed a method of manufacturing a surfboard, the method comprising the steps of: (a) adhering carbon fiber material to one side of the rail of a shaped surfboard blank; (b) laying fiberglass matting over the one side and over the carbon fiber material; (c) applying resin to the one side to cure the carbon fiber material and the fiberglass matting; (d) adhering carbon fiber material to the other side of the rail; (e) laying fiberglass matting over the other side and over the adjacent carbon fiber material; and (f) applying resin to the other side to cure the carbon fiber material and the fiberglass matting.

In these methods, the carbon fiber material is formed as a unidirectional weave and is positioned generally aligned with a longitudinal axis of the blank. The blank may be formed without a stringer or with at least one stringer.

BRIEF DESCRIPTION OF THE DRAWINGS

At least one embodiment of the present invention will now be described with reference to the drawings in which.

DETAILED DESCRIPTION INCLUDING BEST MODE

Figure 1A:
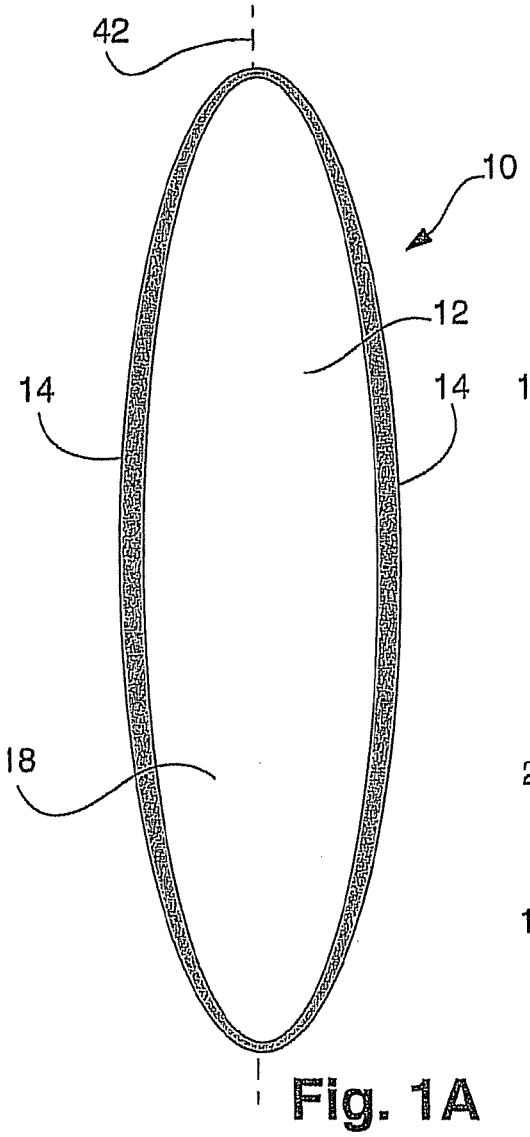
FIG. 1A shows a top plan longitudinal view of a surfboard formed according to the present disclosure.
Figure 1B:
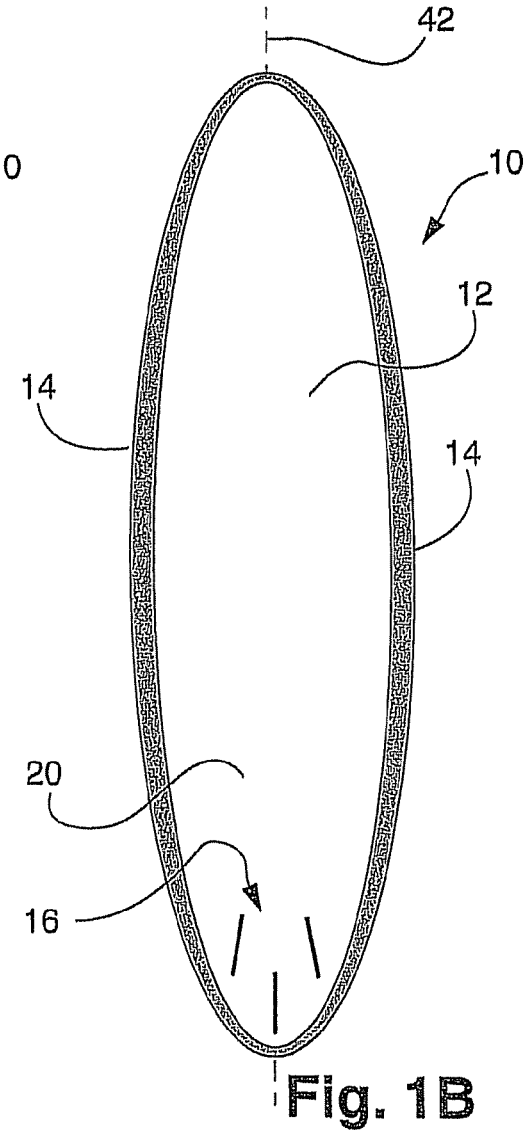
FIG. 1B is a bottom plan view of the surfboard of FIG. 1A.
Figure 1C:
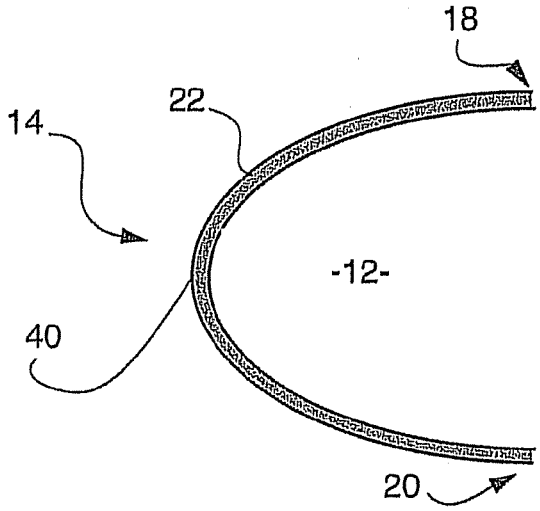
FIG. 1C is a partial transverse cross section of the board of FIGS. 1A and 1B showing the arrangement of the carbon fiber rail.

FIGS. 1A to 1C show a surfboard 10 which is formed using a foam blank 12. The foam blank 12 is preferably manufactured without a stringer, although depending upon the particular specification of the board 10, the blank 12 may also include one or more stringers. The blank 12 is shaped according to any particular desired style to provide a top side (deck) 18 and an under side (bottom) 20 of the surfboard 10. As seen in FIG. 1B, the blank 12 may have one or more recesses 16 permitting insertion or other formation of a corresponding number of fins (not illustrated).

The external generally oval shaped periphery of the surfboard 10, seen in FIGS. 1A and 1B, forms what is known as the rail or rails 14, the transverse cross-sectional detail of part of which is seen in FIG. 1C for a typical portion of the board 10. It is seen in this example that the rail 14 is substantially parabolic in shape. Other rail shapes are known and used in the surfing industry and relate basically to the amount by which the rail is rounded. Rails may also be described as "low", "rolled", "mid-sized" or "high", as seen respectively in FIGS. 3A-3D. The parabolic shape shown in FIG. 1C is something considered to be a compromise between "rolled" and "mid-sized". Different rail shapes afford different responses of the board during maneuvering. It will be appreciated from FIGS. 1C and 3A-3D that any line of demarcation between the rails 14 and the deck 18 and bottom 20 respectively will vary with the shaping of the blank 12.

Whilst the structures described in this patent specification are specifically illustrated with parabolic shaped rails, the arrangements described may also be readily adapted and used upon rails of alternate shapes. As seen in FIG. 1C, the rail 14 is provided with a carbon material 22 which forms around the rail 14 from the deck 18 to the bottom 20.

In a preferred implementation, the carbon rail is formed using carbon fiber webbing or matting which is laminated onto the rail of the blank 10 using the fiberglass resins noted above as suited to the particular foam being used. Such material is therefore well suited to traditional surfboard manufacturing techniques.

The formation of the board 10 is seen in FIGS. 2A to 2E, which shows part of one side of a transverse cross-section of the board 10. The form of construction described is essentially manual, and is akin to and draws upon traditional techniques, although it departs from such techniques through the use and handling of the carbon fibre.

Figure 2A:
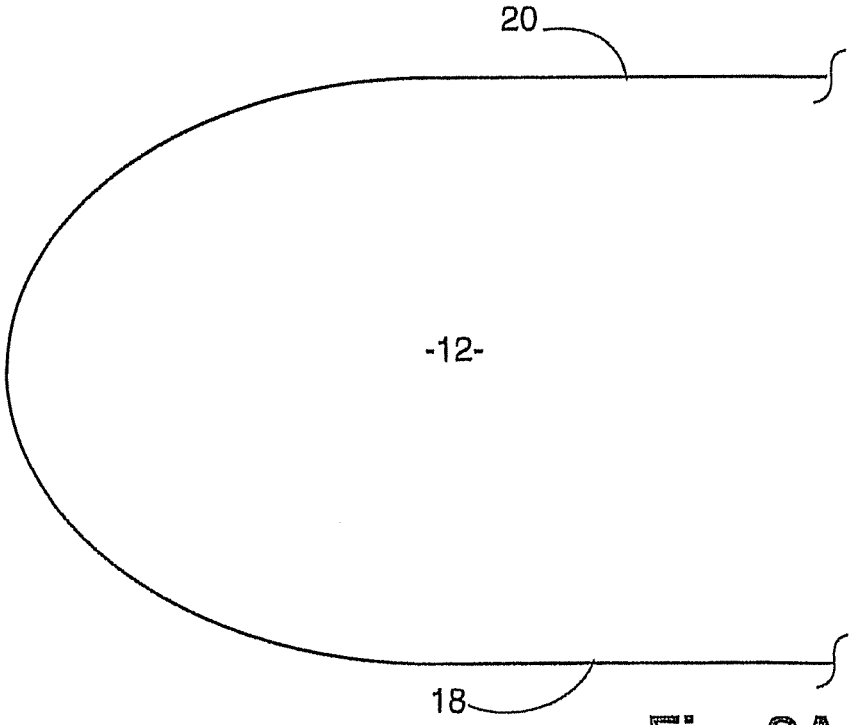
FIGS. 2A-2E are partial cross-sections of the board of FIGS. 1A-1C illustrating a method of manufacturing of the surfboard.

In FIG. 2A, the blank 12 is provided which, as noted above, is preferably stringerless, although it may include one or more stringers if additional rigidity is required. The blank 12 is positioned typically with its bottom 20 facing upwards as that side of the board 10 is that which is traditionally formed first.

Figure 2B:
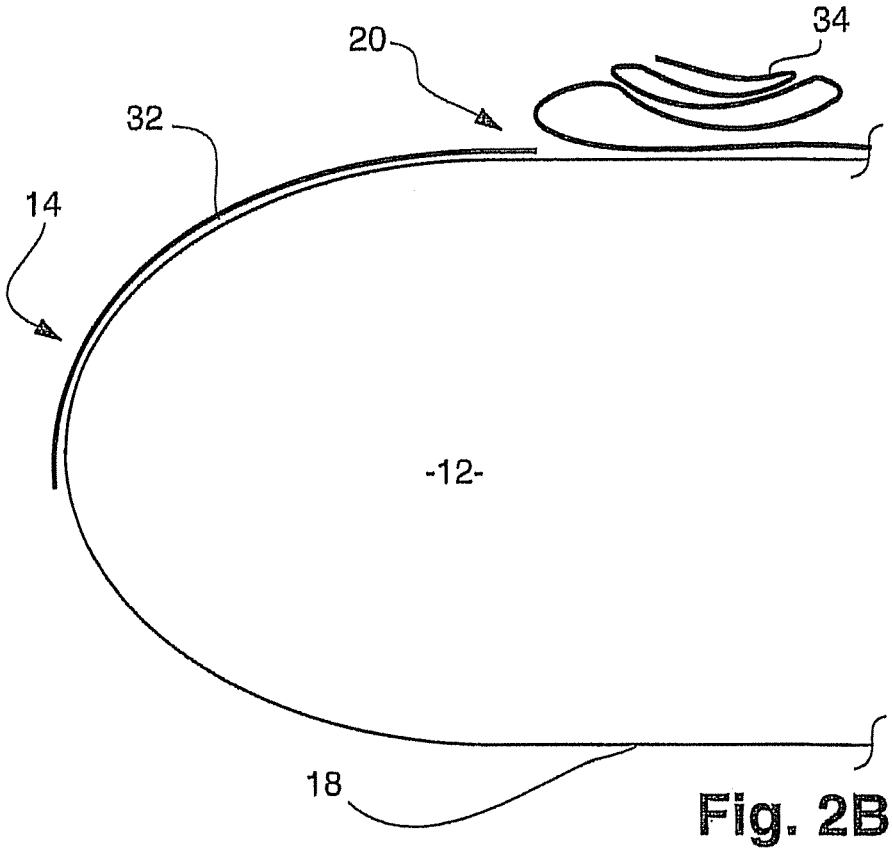

In a next constructional step shown in FIG. 2B, the bottom 20 of the board 10 is laminated. Initially, a small amount of adhesive is brushed or otherwise painted along the rail 14 at or adjacent the bottom 20 and a portion of carbon fiber webbing 32 is applied and adhered to the adhesive on that part of the rail 14 adjacent the bottom 20 and extending onto the bottom 20 as illustrated. During this phase, a non-carbon fiber laminate such as fiberglass matting 34 is provided and positioned on the top side 18 and folded back upon itself whilst the carbon fiber 32 is positioned using the adhesive.

Figure 2C:
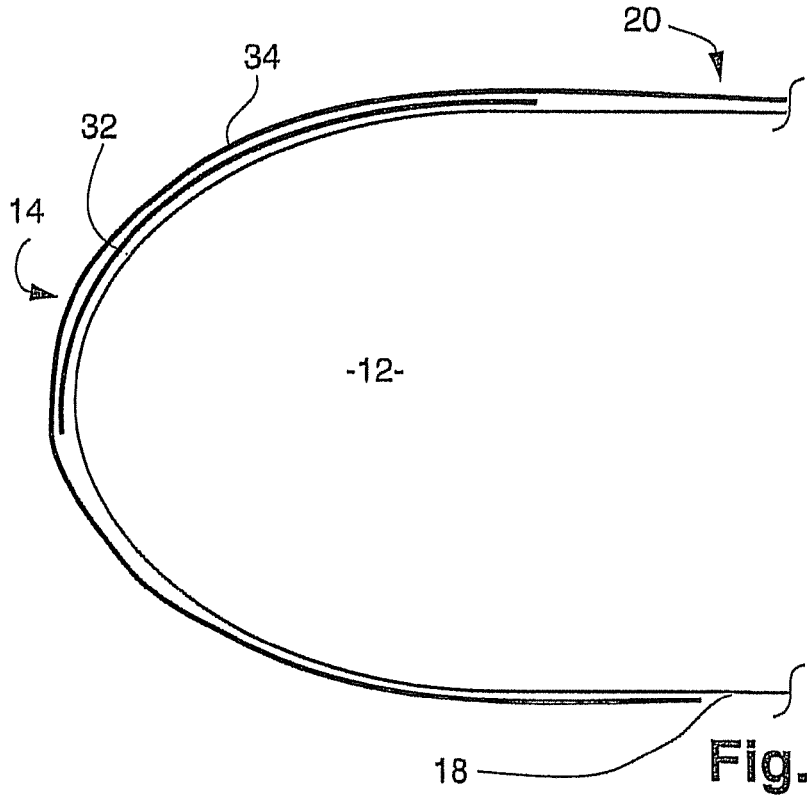

Turning now to FIG. 2C, with the carbon fiber matting 32 properly positioned, the fiberglass webbing 34 is folded over the carbon fiber 32 to enclose and to envelope the bottom 20 of the board 10, and to extend around the rail 14 onto the working underside of the blank 12, being the deck 18. Resin may then be applied to the bottom 20 thereby adhering and encasing the carbon fiber 32 within the outer fiberglass layer 34.

Figure 2D:
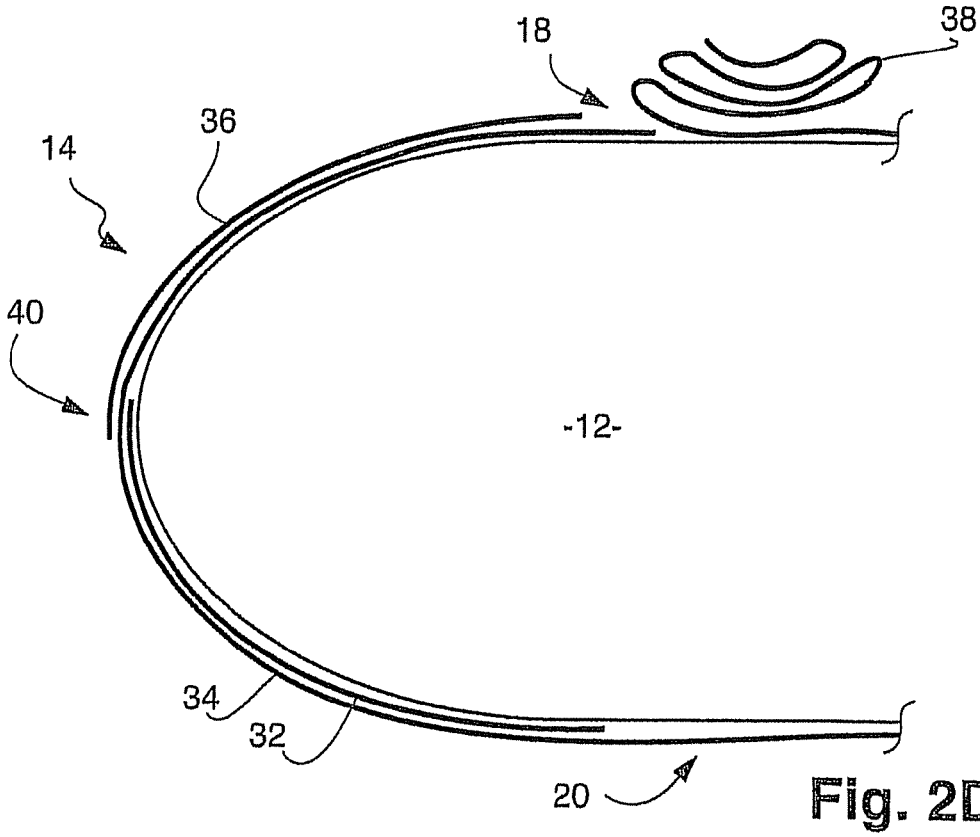
Figure 2E:
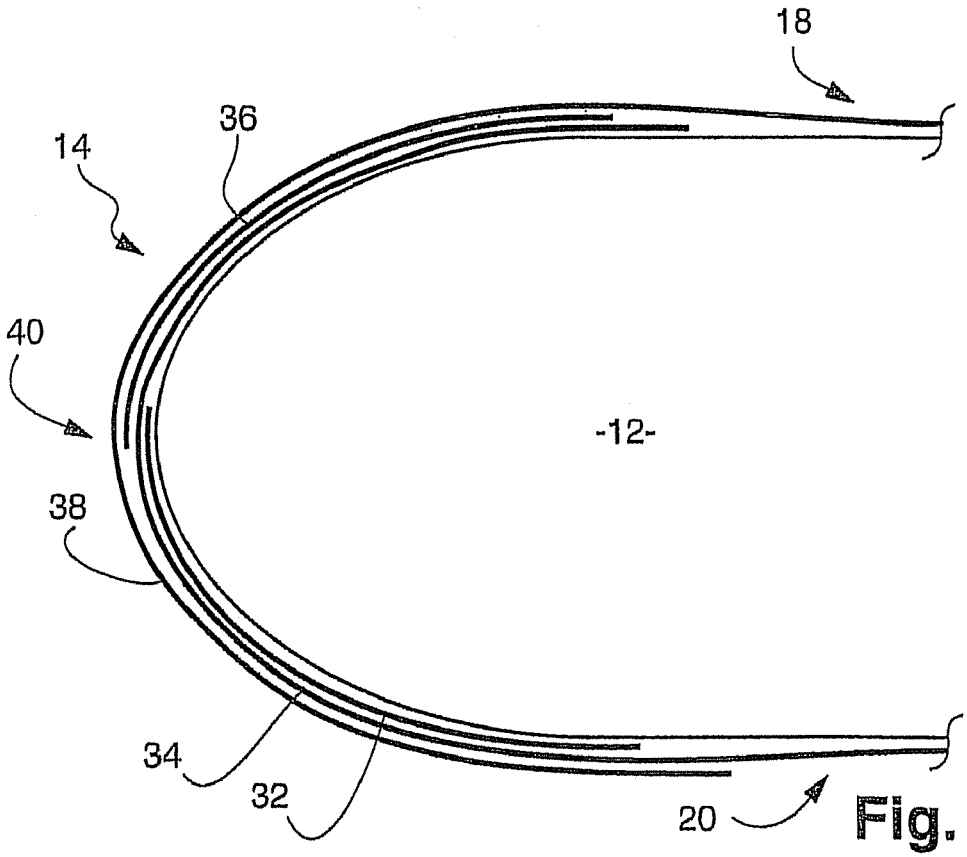
Figures 3A, 3B, 3C, 3D:
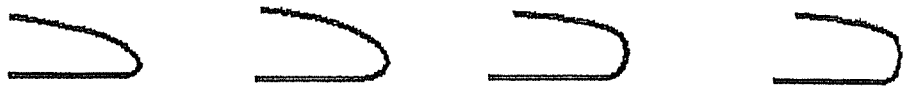
FIGS. 3A-3D show various alternate rail shapes.

As seen in FIG. 2D, when the formed layer on the bottom 20 has cured, the board 10 is flipped and the deck 18 may then be formed in a similar fashion. Again, using adhesive, a further layer 36 of carbon fiber is positioned over the fiberglass matting 34, extending from a periphery 40 of the rail 14 and along and over the rail 14 onto the deck 18. A further layer of fiberglass matting 38 is positioned across the deck 18 and folded onto itself as previously described. When so positioned, as seen in FIG. 2E, the fiberglass matting 38 can then be unfolded and laid over the rail 14 to envelope the carbon fiber 36 and to extend around the rail 14 onto the bottom 20. This forms multiple layers at the periphery 40 of the rail 14 with the two carbon fiber layers 32 and 36 sandwiched in alternate fashion between the external overlapping fiberglass layers 34 and 38, and the blank 12. Resin can then be applied to the matting 36 and 38. The board 10 may then be finished by sanding and polishing in a traditional fashion. In this way, the resin coating can then impregnate each of the fiberglass and carbon fiber layers to provide a rigid and flexible exoskeleton to what may be considered an otherwise spineless (stringerless) foam blank. Notably the carbon fiber material is provided to substantially increase the stiffness of the fail-rails 14, whilst the wrapping of the fiberglass around the rails 14, also aids in protecting the carbon fiber layers from mechanical damage. In this example, whilst the carbon fiber materials extend from the rails onto the bottom and deck it will be appreciated from FIGS. 2B-2E that the carbon fiber is nevertheless applied to substantially only the rails of the blank or surfboard and thus the use of the carbon fiber remains essentially limited to the rails, consistent with the example of FIGS. 1A-1C. This forms a peripheral carbon fiber reinforced frame about the surfboard.

The carbon fiber used to form the rails 14 is preferably a unidirectional weave configured to run length ways along of the surfboard 10, thereby being generally aligned to the longitudinal axis 42, observing that at each end of the board 10 the weave will be transverse the axis 42.

An example of one type of carbon fiber material that may be used is R163-024 150/50 brand marketed by Gurit Aust. of Australia. This product has 150 gm/50 mm unidirectional weave. Other carbon fiber materials having a mass of 260 gm or 500 gm may be used depending upon the strength and weight requirements. The 150 gm material has been found by the present inventor to be particularly useful for "short" boards (less than about 6 feet, 1.8 meters), often used for competition, and heavier materials may be better suited to long boards and the like.

The surfboard 10 has a number of advantages over alternate forms of construction. Firstly, in comparison to the traditional single or triple stringer fiberglass surfboard, the surfboard 10 is of lighter weight in view of the absence of the stringer and provides for a method of construction akin to those traditionally used with fiberglass surfboard manufacture. In comparison to industrialised manufacturing such as the thermoplastic PVC sandwiching methods used by many, such as TUFLITE™, the disclosed arrangements are well suited to traditional customisable manufacture. With the presently described structure, construction only varies marginally from traditional construction, through the additional placement of the carbon fiber weave 32 and 36. The resin steps remain the same.

In an alternate implementation, the carbon fiber materials may be applied to the foam blank in such a way to cover both sides of the rails. This may be achieved using a single matting enveloping the both sides of the rail, or two lengths of matting, as in FIGS. 2A-2E, one for each side of the rail. Resin may then be applied to the rail and cured to provide a strong and rigid periphery to the board. The structure may then be enveloped in a non-carbon fiber laminate such as a thermally formed sandwich or laminate structure formed using thermally active PVC or other suitable materials, thus substantially or entirely removing a need for an external fiberglass laminate.

The use of carbon fiber material has been found by the present inventor to offer strength surpassing six layers of traditional fiberglass matting, at a substantially reduced mass. The reduction in mass whilst maintaining strength, reduces the quantity of foam required for the same amount of buoyancy.

INDUSTRIALLY APPLICABILITY

The arrangements described are applicable to the manufacture of surfboards of all different shapes and styles, including similar products such as knee boards. Surfboard styles well suited to such forms of construction include short boards, fish, Malibu, mini-Mals, long boards, all with a variety of fin and rail arrangements.

The foregoing describes only a number embodiments of the present invention and modifications may be made thereto without departing from the scope of the present invention.

I claim:

1. A method of manufacturing a surfboard using a shaped surfboard blank having peripheral rails, a top side and an under side, the method applying carbon fiber material to substantially only the rails of the shaped surfboard blank and enveloping the carbon fiber applied rails and the shaped surfboard blank in a non-carbon fiber laminate, wherein each rail extends from the top side of the shaped surfboard blank to the under side of the shaped surfboard blank, each rail having one rail side extending from a periphery of the rail to the to under side of the shaped surfboard blank, said method comprising:

(i) adhering carbon fiber material having a unidirectional weave to substantially one side of one of the rails of the shaped surfboard blank, the weave being generally aligned with a longitudinal axis of the shaped surfboard blank;

(ii) laying fiberglass matting over the carbon fiber material;

(iii) applying resin to the laid fiberglass matting;

(iv) adhering carbon fiber material having a unidirectional weave to substantially the other side of the one rail, the weave being generally aligned with the longitudinal axis of the shaped surfboard blank, (v) laying further fiberglass matting over the further carbon fiber material; and (vi) applying resin to the laid further fiberglass matting.

2. A method of manufacturing a surfboard using a shaped surfboard blank having peripheral rails, a top side and an under side, the method applying carbon fiber material to substantially only the rails of the shaped surfboard blank and enveloping the carbon fiber applied rails and the shaped surfboard blank in a non-carbon fiber laminate, wherein each rail extends from the top side of the shaped surfboard blank to the under side of the shaped surfboard blank, each rail having one rail side extending from a periphery of the rail to the top side of the shaped surfboard blank, and another rail side extending from the periphery of the rail to the under side of the shaped surfboard blank, said method comprising:

(i) adhering carbon fiber material having a unidirectional weave to substantially one side of one of the rails of the shaped surfboard blank, the weave being generally aligned with a longitudinal axis of the shaped surfboard blank;

(ii) laying fiberglass matting over the carbon fiber material and over the corresponding one side of the shaped surfboard blank;

(iii) applying resin to the laid carbon fiber material and the fiberglass matting;

(iv) adhering further carbon fiber material having a unidirectional weave to substantially the other side of the one rail, the weave being generally aligned with the longitudinal axis of the shaped surfboard blank;

(v) laying further fiberglass matting over the further carbon fiber material and over the corresponding other side of the shaped surfboard blank; and (vi) applying resin to the laid further carbon fiber material and the further fiberglass matting; wherein the method is repeated for the other of the rails.

* * * * *